US011050154B2

(12) United States Patent
Park

(10) Patent No.: US 11,050,154 B2
(45) Date of Patent: Jun. 29, 2021

(54) CHIP ANTENNA

(71) Applicant: Samsung Electro-Mechanics., Ltd., Suwon-si (KR)

(72) Inventor: Ju Hyoung Park, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 174 days.

(21) Appl. No.: 16/441,541

(22) Filed: Jun. 14, 2019

(65) Prior Publication Data

US 2020/0161768 A1 May 21, 2020

(30) Foreign Application Priority Data

Nov. 21, 2018 (KR) ..... 10-2018-0144539

(51) Int. Cl.

| | |
|---|---|
| ***H01Q 9/04*** | (2006.01) |
| ***H01Q 1/48*** | (2006.01) |
| ***H01Q 1/22*** | (2006.01) |
| ***H01Q 21/06*** | (2006.01) |
| ***H01Q 1/24*** | (2006.01) |

(52) U.S. Cl.
CPC ..... *H01Q 9/0407* (2013.01); *H01Q 1/2283* (2013.01); *H01Q 1/48* (2013.01); *H01Q 21/065* (2013.01); *H01Q 1/243* (2013.01)

(58) Field of Classification Search
CPC ..... H01Q 1/2283; H01Q 1/243; H01Q 1/36; H01Q 1/38; H01Q 1/40; H01Q 9/16; H01Q 9/28; H01Q 9/285; H01Q 9/0407; H01Q 19/28; H01Q 19/30; H01Q 19/32; H01L 23/66; H01L 2223/66
See application file for complete search history.

(56) References Cited

U.S. PATENT DOCUMENTS

2005/0243001 A1 11/2005 Miyata et al.
2017/0069958 A1* 3/2017 Ko ..... H01Q 1/243

FOREIGN PATENT DOCUMENTS

| | | | |
|---|---|---|---|
| JP | 2000-232315 A | | 8/2000 |
| JP | 2000-278037 A | * | 10/2000 |
| KR | 10-0663018 B1 | | 12/2006 |
| KR | 10-0930618 B1 | | 12/2009 |
| WO | WO-2010090499 A2 | * | 8/2010 |

* cited by examiner

*Primary Examiner* — Robert Karacsony
(74) *Attorney, Agent, or Firm* — NSIP Law

(57) ABSTRACT

A chip antenna includes: a body portion; a radiating portion disposed on one surface of the body portion in a width direction; and a ground portion disposed on another surface of the body portion in a width direction, wherein the radiating portion includes a dielectric substance and a conductor, and the dielectric substance and the conductor are respectively disposed in different regions in a thickness direction.

16 Claims, 9 Drawing Sheets

II–II'

CHIP ANTENNA

CROSS-REFERENCE TO RELATED APPLICATIONS

This application claims the benefit under 35 U.S.C. § 119(a) of Korean Patent Application No. 10-2018-0144539 filed on Nov. 21, 2018 in the Korean Intellectual Property Office, the entire disclosure of which is incorporated herein by reference for all purposes.

BACKGROUND

1. Field

The following description relates to a chip antenna.

2. Description of Related Art

A 5G communications system is implemented in higher frequency bands (mmWave), between 10 GHz and 100 GHz, for example, to attain a high data transfer rate. To reduce loss of radio waves and to increase a transmission distance, techniques such as beamforming, large-scale multiple-input multiple-output (MIMO), full dimensional multiple-input multiple-output (FD-MIMO), implementation of an array antenna, analog beamforming, and other large-scale antenna techniques have been considered in the 5G communications system.

Mobile communication terminals such as mobile phones, PDAs, navigation devices, laptops, and the like, which support wireless communications have been designed to have functions such as CDMA, wireless LAN, DMB, near field communication (NFC), and the like. One of the main components that enable such functions is an antenna.

However, it may be difficult to use a generally used antenna in the GHz bands applied in a 5G communications system, since wavelengths are as small as several millimeters in the GHz bands. Thus, a small-sized chip antenna module that can be mounted on a mobile communication device and can be used in GHz bands is required.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna includes: a body portion; a radiating portion disposed on one surface of the body portion in a width direction; and a ground portion disposed on another surface of the body portion in a width direction, wherein the radiating portion includes a dielectric substance and a conductor, and the dielectric substance and the conductor are respectively disposed in different regions in a thickness direction.

A thickness of the conductor may be different from a thickness of the dielectric substance.

The thickness of the conductor may be greater than the thickness of the dielectric substance.

The conductor and the dielectric substance may have a same thickness.

The conductor may be disposed on two ends of the radiating portion in a thickness direction.

A length and a width of each of the conductor and the dielectric substance may be the same as a length and a width, respectively, of the radiating portion.

The dielectric substance and the body portion may be formed of a same material.

The conductor may include a plurality of conductors, and the dielectric substance may include a plurality of dielectric substances. Dielectric substances among the plurality of dielectric substances may be disposed between conductors among the plurality of conductors.

In another general aspect a chip antenna includes: a body portion; a radiating portion disposed on one surface of the body portion in a width direction; and a ground portion disposed on another surface of the body portion in a width direction, wherein the radiating portion includes a plurality of dielectric substances and a plurality of conductors, and the plurality of dielectric substances and the plurality of conductors are respectively disposed in different regions in a length direction.

A length of each of the conductors may be different from a length of each of the dielectric substances.

The length of each of the conductors may be greater than the length of each of the dielectric substances.

A length of each of the conductors may be the same as a length of each of the dielectric substances.

Two conductors among the plurality of conductors may be respectively disposed on two ends of the radiating portion in a length direction.

A thickness and a width of each of the conductors and each of the dielectric substances may be the same as a thickness and a width, respectively, of the radiating portion.

The dielectric substances and the body portion may be formed of a same material.

Dielectric substances among the plurality of dielectric substances may be disposed between conductors among the plurality of conductors.

In another general aspect, a chip antenna includes: a body portion; a radiating portion disposed on a first side surface of the body portion; and a ground portion disposed on a second side surface of the body portion, opposite the radiating portion, wherein the radiating portion includes a dielectric substance and a conductor.

The dielectric substance and the conductor may be disposed adjacent to each other in a direction parallel to a plane of the first side surface.

The body portion may be formed of a dielectric material.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
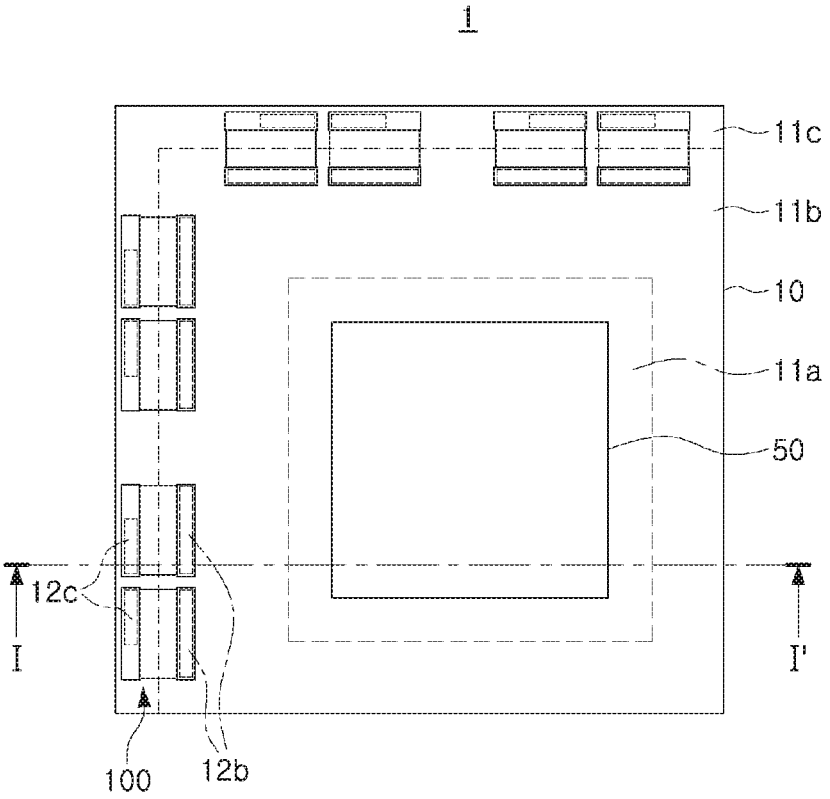
FIG. 1 is a plan diagram illustrating a chip antenna module, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

In the drawings, the thicknesses, sizes, and shapes of lenses have been slightly exaggerated for convenience of explanation. Particularly, the shapes of spherical surfaces or aspherical surfaces illustrated in the drawings are illustrated by way of example. That is, the shapes of the spherical surfaces or the aspherical surfaces are not limited to those illustrated in the drawings.

The chip antenna module in the example embodiments may operate in a high frequency range, in a frequency band between 3 GHz to 60 GHz, for example. The chip antenna module in the example embodiments may be mounted on an electronic device configured to receive, or to receive and transmit, a wireless signal. For example, the chip antenna may be mounted on a portable phone, a portable laptop, a drone, and the like.

Figure 2:
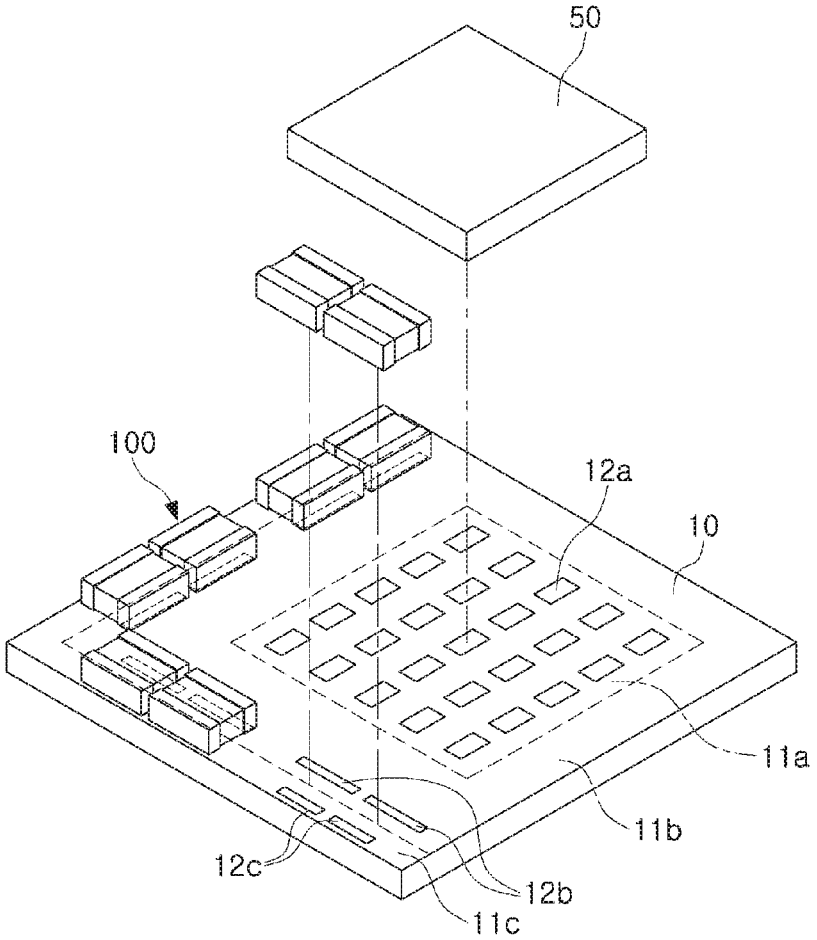
FIG. 2 is an exploded perspective diagram illustrating the chip antenna module illustrated in FIG. 1.
Figure 3:
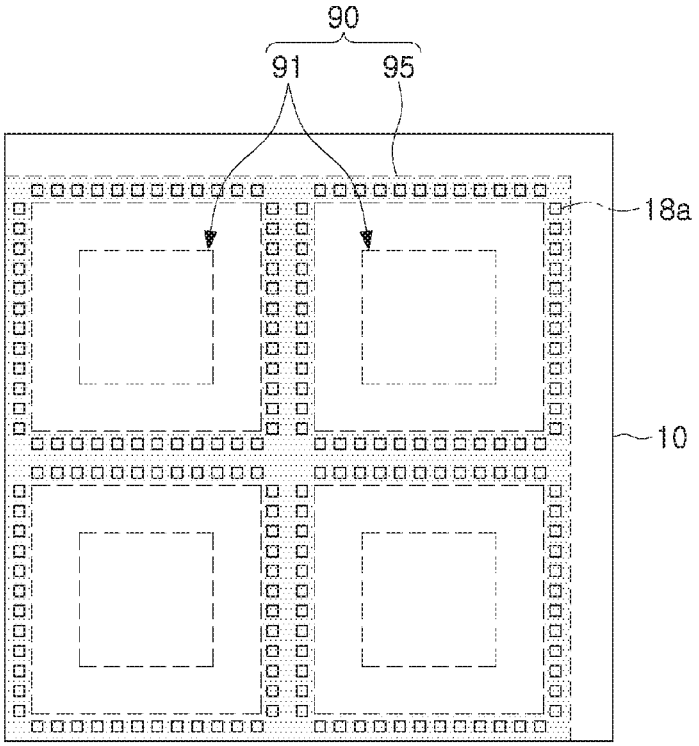
FIG. 3 is a diagram illustrating the chip antenna module illustrated in FIG. 1, viewed from the below.
Figure 4:
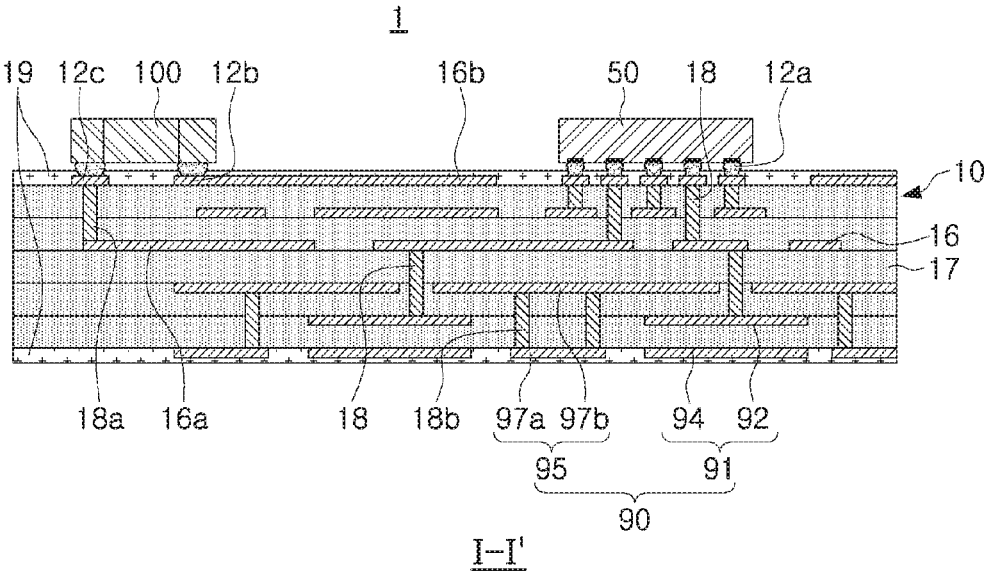
FIG. 4 is a cross-sectional diagram taken along line I-I' in FIG. 1.

FIG. 1 is a plan diagram illustrating a chip antenna module 1, according to an embodiment. FIG. 2 is an exploded perspective diagram illustrating the chip antenna module 1. FIG. 3 is a diagram illustrating the chip antenna module 1, viewed from the bottom. FIG. 4 is a cross-sectional diagram taken along line I-I' in FIG. 1.

Referring to FIGS. 1 to 4, the chip antenna module 1 may include a substrate 10, an electronic element 50, and a chip antenna 100.

The substrate 10 may be a circuit substrate on which a circuit or an electronic component required for a wireless antenna is mounted. For example, the substrate 10 may be a printed circuit board (PCB) including one or more electronic components therein or on a surface thereof. Thus, the substrate 10 may include circuit wiring lines electrically connecting electronic components.

As shown in FIG. 4, the substrate 10 may be a multilayer substrate formed by alternately layering insulting layers 17 and wiring layers 16. In example embodiments, wiring layers 16 may be formed on two opposite surfaces of a single insulating layer 17.

A material of the insulating layers 17 may not be limited to any particular material. For example, a material of the insulating layers 17 may be a thermosetting resin such as an epoxy resin, a thermoplastic resin such as a polyimide, a resin in which the thermosetting resin or the thermoplastic resin is impregnated together with an inorganic filler in a core material as a glass fiber (a glass cloth or a glass fabric), such as prepreg, ajinomoto build-up film (ABF), FR-4, bismaleimide triazine (BT), or the like, for example. If desired, a photoimageable encapsulant resin (a photoimageable dielectric substance, PID) may also be used.

As shown in FIG. 4, the wiring layers 16 may electrically connect the electronic element 50 to the antennas 90 and 100, and may electrically connect the electronic element 50 or the antennas 90 and 100 to an external entity. A conductive material such as copper (Cu), aluminum (Al), silver (Ag), tin (Sn), gold (Au), nickel (Ni), lead (Pb), titanium (Ti), or alloys of Cu, Al, Ag, Sn Au, Ni, Pb or Ti may be used as a material of the wiring layer 16.

Interlayer connection conductors 18 may be disposed inside the insulating layer 17 to interconnect the wiring layers 16 layered therein.

Still referring to FIG. 4, insulating protective layers 19 may be respectively disposed on an upper surface and a lower surface of the substrate 10. The insulating protective layers 19 may respectively cover the uppermost and lowermost insulating layers 17 and the wiring layers 16 disposed on an upper surface of the uppermost insulating layer 17 and a lower surface of the lowermost insulating layer 17, and may protect the wiring layers 16 disposed on the upper surface of the uppermost insulating layer 17 and the lower surface of the lowermost insulating layer 17.

The insulating protective layers 19 may have openings exposing at least a portion of the uppermost and lowermost wiring layers 16, respectively. The insulating protective layer 19 may include an insulating resin and an inorganic filler, and may not include a glass fiber. As an example, a solder resist may be used as the insulating protective layer 19, but a material of the insulating protective layer 19 is not limited to a solder resist.

Various types of generally used substrates (e.g., a printed circuit board, a flexible substrate, a ceramic substrate, a glass substrate, and the like) may be used as the substrate 10.

Referring to FIG. 2, a first surface, or upper surface, of the substrate 10, may be divided into an element mounting portion 11*a*, a ground region 11*b*, and a feed region 11*c*.

The element mounting portion 11*a* may be a region in which the electronic element 50 is mounted, and may be disposed within the ground region 11*b*. The element mounting portion 11*a* may include connection pads 12*a* to which the electronic element 50 is electrically connected.

The ground region 11*b* may be a region in which a ground wiring layer 16*b* (see FIG. 4) is disposed, and may surround the element mounting portion 11*a*. Thus, the element mounting portion 11*a* may be disposed within the ground region 11*b*.

One of the wiring layers 16 of the substrate 10 may be used as the ground wiring layer 16*b*. Thus, the ground wiring layer 16*b* may be disposed on an upper surface of the insulating layer 17 or between two layered insulating layers 17.

In the example embodiment, the element mounting portion 11*a* may have a quadrangular shape. Thus, the ground region 11*b* may surround the element mounting portion 11*a* in a form of quadrangular ring. In example embodiments, a shape of the element mounting portion 11*a* may vary.

As shown in FIG. 2, the ground region 11*b* may be disposed along a circumference of the element mounting portion 11*a*. Accordingly, the connection pads 12*a* of the element mounting portion 11*a* may be electrically connected to an external entity or other elements by the interlayer connection conductor 18 penetrating the insulating layers 17 of the substrate 10.

As shown in FIGS. 2 and 4, ground pads 12*b* may be disposed in the ground region 11*b*. When the ground wiring layer 16*b* is disposed on the upper surface of the insulating layer 17, the ground pads 12*b* may be formed by partially opening the insulating protective layer 19 covering the ground wiring layer 16*b*. Thus, in this case, the ground pad 12*b* may become one portion of the ground wiring layer 16*b*. However, the disclosure is not limited to the foregoing an example. When the ground wiring layer 16*b* is disposed between two insulting layers 17, the ground pad 12*b* may be disposed on an upper surface of one of the two insulating layers 17, and the ground pad 12*b* and the ground wiring layer 16*b* may be connected to each other through the interlayer connection conductor.

The ground pads 12*b* may be configured to form a pair with a feed pad 12*c*. Thus, the ground pads 12*b* may be disposed adjacent to the feed pads 12*c*.

As illustrated in FIG. 2, the feed region 11*c* may be disposed externally of the ground region 11*b*. In the example embodiment, the feed region 11*c* may be formed externally of two sides formed by the ground region 11*b*. Thus, the feed region 11*c* may be disposed along edges of the substrate, at least partially around a perimeter of the ground region 11*b*. However, the disclosure is not limited to the foregoing configuration.

As shown in FIG. 2, a plurality of the feed pads 12*c* may be disposed in the feed region 11*c*. The feed pads 12*c* may be disposed on an upper surface of the insulating layer 17, and may be bonded to a radiating portion 130*a* of the chip antenna 100 (see FIGS. 5 and 6).

As shown in FIG. 4, the feed pad 12*c* may be electrically connected to the electronic element 50 or other elements via a feed via 18*a* penetrating one or more of the insulating layers 17 of the substrate 10, and a feed wiring layer 16*a*. The feed pad 12*c* may be provided with a feed signal through the feed via 18*a* and the feed wiring layer 16*a*.

The element mounting portion 11*a*, the ground region 11*b*, and the feed region 11*c* may be distinguished from one another by a shape or a position of the ground wiring layer 16*b* disposed on an upper portion of the substrate 10. Also, the connection pad 12*a*, the ground pad 12*b*, and the feed pad 12*c* may be externally exposed in pad form through an opening from which the insulating protective layer 19 is removed.

The feed pad 12*c* may have a length or an area the same as or similar to a length or an area of a lower surface of the radiating portion 130*a*. In example embodiments, a length or an area of the feed pad 12*c* may be one half or less of a length or an area of a lower surface of the radiating portion 130*a*. In this case, the feed pad 12*c* may only be bonded to a portion of the lower surface of the radiating portion 130*a*, rather than being bonded to an overall lower surface of the radiating portion 130*a*.

As shown in FIGS. 3 and 4, a patch antenna 90 may be disposed on a second surface, or lower surface, of the substrate 10. The patch antenna 90 may be formed by the wiring layers 16 provided on the substrate 10.

As illustrated in FIGS. 3 and 4, the patch antenna 90 may include a feed portion 91 including a driven patch 92 and a coupling patch 94, and a ground portion 95.

Referring to FIG. 3, in the patch antenna 90, a plurality of the feed portions 91 may be distributed on the second surface of the substrate 10. In the example embodiment, four feed portions 91 may be provided, but the disclosure is not limited to such a configuration.

The driven patch 92 may be formed of a planar, plate shaped metal layer having a specified area, and may be configured as a single conductor plate. The driven patch 92 may have a polygonal structure, and in the example embodiment, the driven patch 92 may have a quadrangular shape. However, the disclosure is not limited to this example, and the driven patch 92 may have a circular shape, or another shape.

As shown in FIG. 4, the driven patch 92 may be connected to the electronic element 50 by the interlayer connection conductor 18. The interlayer connection conductor 18 may penetrate through a second ground wiring layer 97*b* and may be connected to the electronic element 50.

The coupling patch 94 may be spaced apart from the driven patch 92 by a specified distance, and may be a single planar conductor plate having a specified area. The coupling patch 94 may have an area the same as or similar to an area of the driven patch 92. As an example, an area of the coupling patch 94 may be larger than an area of the driven patch 92 such that the coupling patch 94 may face an entire area of the driven patch 92.

The coupling patch 94 may be disposed externally of the driven patch 92. Thus, the coupling patch 94 may be disposed on the wiring layer 16 disposed in a lowermost portion of the substrate 10 (e.g., the wiring layer 16 disposed on the lower surface of the lowermost insulating layer 17).

As shown in FIGS. 3 and 4, the ground portion 95 may surround the feed portion 91. To this end, the ground portion 95 may include a first ground wiring layer 97*a*, a second ground wiring layer 97*b*, and a ground via 18*b*.

As shown in FIG. 4, first ground wiring layer 97*a* may be disposed on the same layer on which the coupling patch 94 is disposed, and may be disposed around the coupling patch 94 and may surround the coupling patch 94. The first ground wiring layer 97*a* may be spaced apart from the coupling patch 94 by a specified distance.

The second ground wiring layer 97*b* may be disposed on another wiring layer 16, different from the wiring layer on which the first ground wiring layer 97*a* is disposed. As an example, the second ground wiring layer 97*b* may be disposed between the driven patch 92 and the first surface of the substrate 10. In this case, the driven patch 92 may be disposed between the coupling patch 94 and the second ground wiring layer 97*b*.

The second ground wiring layer 97*b* may be disposed in an overall area (e.g., substantially an entire area) of the respective wiring layer 16, and only a portion in which the interlayer connection conductor 18 connected to the driven patch 92 is disposed may be removed.

The ground via 18*b* may be an interlayer connection conductor electrically connecting the first ground wiring layer 97*a* and the second ground wiring layer 97*b* to each other, and a plurality of ground vias 18*b* may be disposed to surround the driven patch 92 and the coupling patch 94. The ground vias 18*b* may be disposed in one column, but the disclosure is not limited to this example. If desired, the ground vias 18*b* may be disposed in multiple columns. Accordingly, the feed portion 91 may be disposed in a ground portion 95 having a form of a container, which is formed by the first ground wiring layer 97*a*, the second ground wiring layer 97*b*, and the ground via 18*b*.

Thus, the feed portion 91 of the patch antenna 90 may radiate a wireless signal in a thickness direction (towards a lower portion, for example) of the substrate 10.

The first ground wiring layer 97*a* and the second ground wiring layer 97*b* may not be disposed in a region opposing the feed region (11*c* in FIG. 2) defined on the first surface of the substrate 10. The configuration described above may reduce interference between a wireless signal radiated from the chip antenna 100 and the ground portion 95, but the disclosure is not limited to such a configuration.

The patch antenna 90 may be configured to include a single driven patch 92 and a single coupling patch 94, but the disclosure is not limited to this example. In example embodiments, the patch antenna 90 may only include the driven patch 92, or may include a plurality of the driven patches 92 and a plurality of the coupling patches 94.

The electronic element 50 may be mounted on the element mounting portion 11*a* of the substrate 10. The electronic element 50 may be bonded to the connection pad 12*a* of the element mounting portion 11*a* using a conductive adhesive as a medium.

A single electronic element 50 may be mounted on the element mounting portion 11*a*, but the disclosure is not limited to this example. If desired, a plurality of electronic elements 50 may be mounted.

The electronic element 50 may include at least one active element. For example, the electronic element 50 may include a signal processing element which applies a feed signal to the radiating portion 130*a* of the antenna. If desired, the electronic element 50 may also include a passive device.

The chip antenna 100 may be used in wireless communications performed in Ghz frequency bands. The chip antenna 100 may be mounted on the substrate 10, may receive feed signals from the electronic element 50, and may externally radiate the feed signals.

The chip antenna 100 may have a hexahedral shape. Both ends of the chip antenna 100 may be bonded to the feed pad 12*c* and the ground pad 12*b* of the substrate 10, respectively, using a conductive adhesive such as a solder, and the chip antenna 100 may be mounted on the substrate 10.

Figure 5:
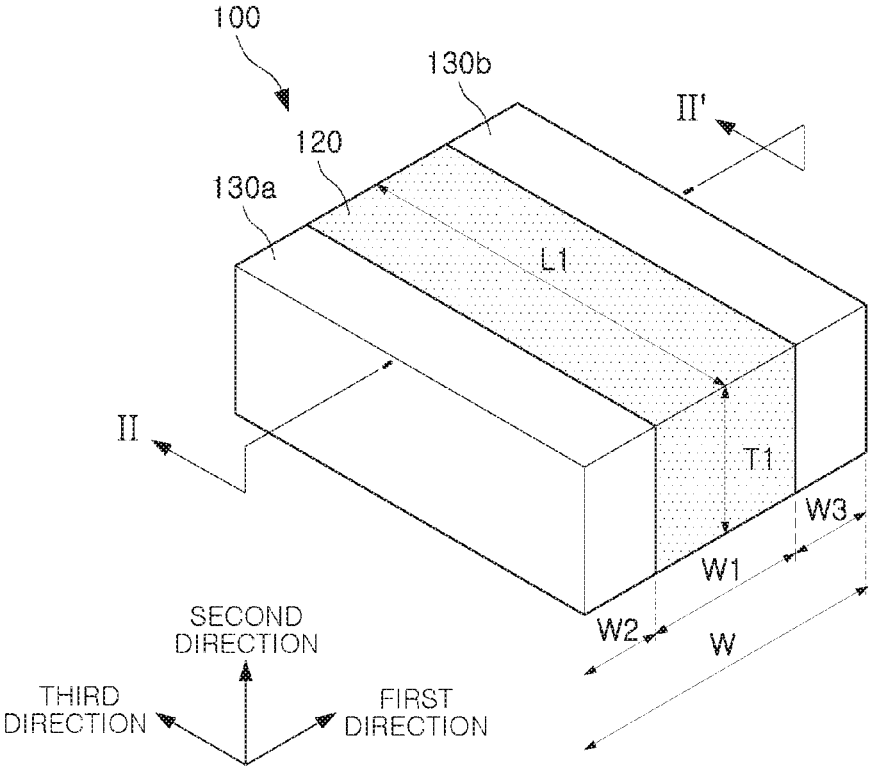
FIG. 5 is an enlarged perspective diagram illustrating a chip antenna illustrated in FIG. 1.
Figure 6:
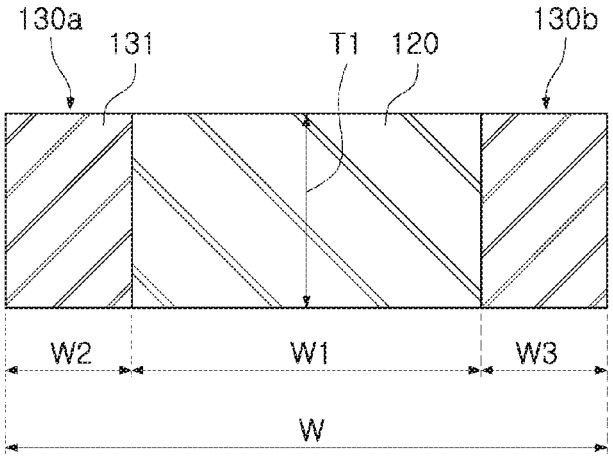
FIG. 6 is a cross-sectional diagram taken along line II-II-' in FIG. 5.

FIG. 5 is an enlarged perspective diagram illustrating the chip antenna 100. FIG. 6 is a cross-sectional diagram taken along line II-II' in FIG. 5. Referring to FIGS. 5 and 6, the chip antenna 100 may include a body portion 120, a radiating portion 130*a*, and a ground portion 130*b*.

The body portion 120 may have a hexahedral shape, and may be formed of a dielectric substance. As an example, the body portion 120 may be formed of a polymer or a ceramic sintered substance having a dielectric constant. The body portion 120 may be formed of a material having a dielectric constant of 3.5 to 25. The body portion 120 may be formed of a material having a dielectric constant significantly higher than a dielectric constant of air to reduce a length of the chip antenna.

The radiating portion 130*a* may be coupled to a first surface of the body portion 120. The ground portion 130*b* may be coupled to a second surface of the body portion 120. The first surface and the second surface may refer to two surfaces of the body portion 120 facing opposite directions, with the body portion 120 being configured as a hexahedron.

In the example embodiment, a width W1 of the body portion 120 may be defined as a distance between the first surface and the second surface. Thus, a direction from the first surface of the body portion 120 to the second surface (or a direction from the second surface of the body portion 120 to the first surface) may be defined as a width direction of the body portion 120 or the chip antenna 100.

Widths W2 and W3 of the radiating portion 130*a* and the ground portion 130*b* may be defined as a distance taken in a width direction of the chip antenna. Thus, the width W2 of the radiating portion 130*a* may refer to a minimum distance from a surface of the radiating portion 130*a* bonded to the first surface of the body portion 120 to a surface opposite to the bonded surface, and the width W3 of the ground portion 130*b* may refer to a minimum distance from a surface of the ground portion 130*b* bonded to the second surface of the body portion 120 to an surface opposite to the bonded surface.

The radiating portion 130*a* may be in contact with only one surface among six surfaces of the body portion 120, and may be coupled to the body portion 120. Similarly, the ground portion 130*b* may also be in contact with only one surface among six surfaces of the body portion 120, and may be coupled to the body portion 120. The radiating portion 130*a* and the ground portion 130*b* may not be disposed on the other surfaces except the first surface and the second surface, and may be disposed parallel to each other with the body portion 120 therebetween.

The radiating portion 130*a* and the ground portion 130*b* may be formed of the same material, and may have the same shape and the same structure. In this case, the radiating portion 130*a* and the ground portion 130*b* may be distinguished from each other by a type of pad to which the radiating portion 130*a* and the ground portion 130*b* are bonded when being mounted on the substrate 10.

As an example, a portion bonded to a feed pad 12*c* of the substrate 10 may function as the radiating portion 130*a*, and a portion bonded to a ground pad 12*b* of the substrate 10 may function as the ground portion 130*b*. However, the disclosure is not limited to this example.

The radiating portion 130*a* and the ground portion 130*b* may include a conductor 131. The conductor 131 may be directly bonded to the body portion 120, and may be formed as a block. A thickness and a length of the conductor 131 may be the same as thickness T1 and length L1 of the body portion 120.

The conductor 131 may be formed on one surface of the body portion 120 through a printing process or a plating process, and may be formed of one of elements selected from among Ag, Au, Cu, Al, Pt, Ti, Mo, Ni, and W, or alloys thereof. The conductor 131 may also be formed of a conductive paste made of a metal containing organic materials such as a polymer, glass, and the like, or a conductive epoxy.

Referring to FIGS. 5 and 6, the thickness T1 of the radiating portion 130*a* and the ground portion 130*b* may be configured to be the same as the thickness T1 of the body portion 120, and the length L1 of the radiating portion 130*a* and the ground portion 130*b* may be the same as the length L1 of the body portion 120.

Since the radiating portion 130*a* and the ground portion 130*b* are in contact with only one surface of the body portion 120, a resonance frequency may easily be tuned out, and an antenna radiation efficiency may be increased by adjusting a volume of the antenna. As an example, a resonance frequency of the chip antenna 100 may easily be adjusted by changing the length L1 of the body portion 120 and the length L1 of the radiating portion 130*a* and the ground portion 130*b*. However, when a resonance frequency is adjusted by adjusting a volume of the chip antenna 100, a spaced distance between adjacent chip antennas 100 may also need to be adjusted in accordance with the changed volume of the chip antenna 100, and thus, the method of tuning a resonance frequency by adjusting a volume of the chip antenna 100 may have several limitations in terms of design.

The radiating portion 130*a* may include a conductor and a dielectric substance to easily adjust a resonance frequency of the chip antenna 100, which may expand a bandwidth and may improve a gain.

Figure 7:
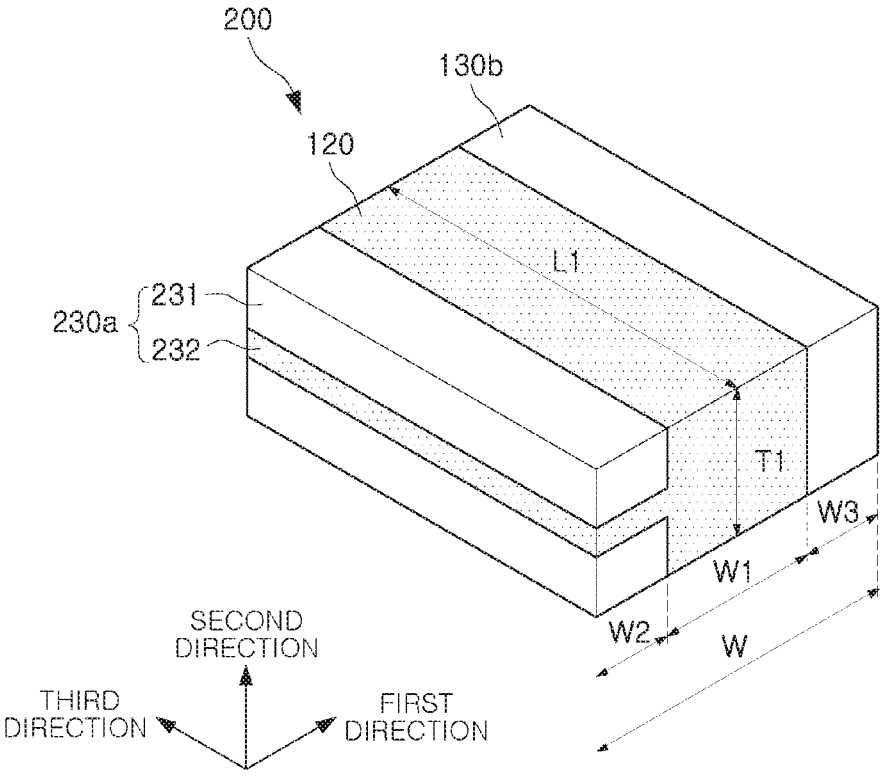
FIGS. 7 and 8 are perspective diagrams illustrating chip antennas, according to embodiments.
Figure 8:
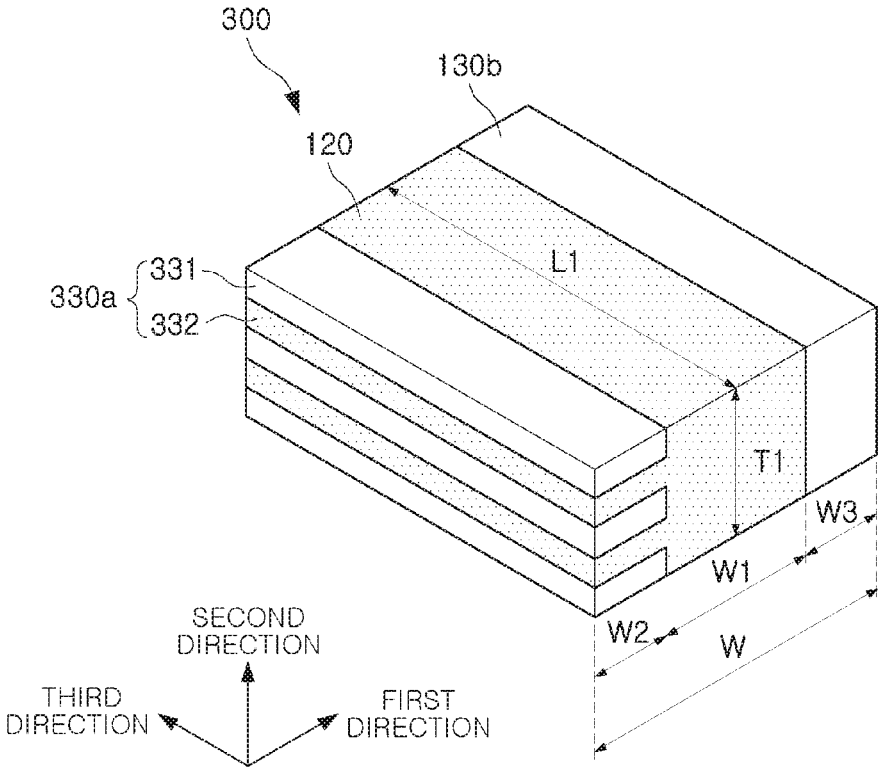

FIGS. 7 and 8 are perspective diagrams illustrating chip antennas 200 and 300, respectively, according to embodiments.

Referring to FIG. 7, in the description below, it is assumed that, in the chip antenna 200, a radiating portion 230*a* and the ground portion 130*b* may be bonded to the body portion 120 in a width direction (first direction), and the chip antenna 200 may be mounted on the substrate 10 in a thickness direction (second direction) such that the body portion 120, the radiating portion 230*a*, and the ground portion 130*b* may oppose the substrate 10, for ease of description. A direction perpendicular to the width direction (first direction) and the thickness direction (second direction) may be defined as a length direction (third direction) of the chip antenna 200.

The radiating portion 230*a* in the example embodiment may include a conductor 231 and a dielectric substance 232.

The conductor 231 and the dielectric substance 232 each may have a length and a width the same as length L1 and width W2 of the radiating portion 230*a*. The conductor 231 and the dielectric substance 232 may be disposed in different regions of the radiating portion 230*a* in the thickness direction (second direction).

As an example, a plurality of the conductors 231 may be provided, and the plurality of conductors 231 may be spaced apart from each other in the thickness direction (second direction). The dielectric substance 232 may be disposed between the conductors 231. The dielectric substance 232 may be interposed between the conductors 231. Thus, one surface and another surface of the dielectric substance 232 taken in the thickness direction may be bonded to the conductors 231, and the conductors 231 may be disposed on both ends of the radiating portion 230*a* in the thickness direction.

Since the conductors 231 and the dielectric substance 232 each have a length and a width that are the same as the length L1 and the width W2, respectively, of the radiating portion 230*a*, one surface and another surface of each of the conductors 231 and the dielectric substance 232 taken in the length direction may be externally exposed. One surface of each of the conductors 231 and the dielectric substance 132 taken in the width direction may be externally exposed, and the other surface of each of the conductors 231 and the dielectric substance 232 may be bonded to the body portion 120. As an example, the dielectric substance 232 may be the same as a material of the body portion 120.

The conductor 231 and the dielectric substance 232 may have different thicknesses. As an example, a thickness of the conductor 231 may be configured to be greater than a thickness of the dielectric substance 232. In the example embodiment, the conductor 231 may be configured to have a thickness greater than a thickness of the dielectric substance 232 such that radiating properties of the chip antenna 200 may be improved. However, in example embodiments, the conductor 231 and the dielectric substance 232 may have the same thickness.

Referring to FIG. 7, the radiating portion 230*a* of the chip antenna 200 may include two conductors 231 and a single dielectric substance 232 disposed between the two conductors 231.

Referring to FIG. 8, a radiating portion 330*a* of a chip antenna 300 may include three conductors 331 and two dielectric substances 332 disposed among the three conductors 331. Also, in other example embodiments, the radiating portion 330*a* of the chip antenna 300 may include four or more conductors 331 and three or more dielectric substances 332.

FIGS. 7 and 8 illustrate examples in which thicknesses of the conductors 231/331 may be the same, but in other example embodiments, thicknesses of the conductors 231/331 may be different from one another. Similarly, FIG. 8 illustrates the example in which thicknesses of the dielectric substances 332 are the same, but in other example embodiments, thicknesses of the dielectric substances 332 may be different from each other.

Figure 9:
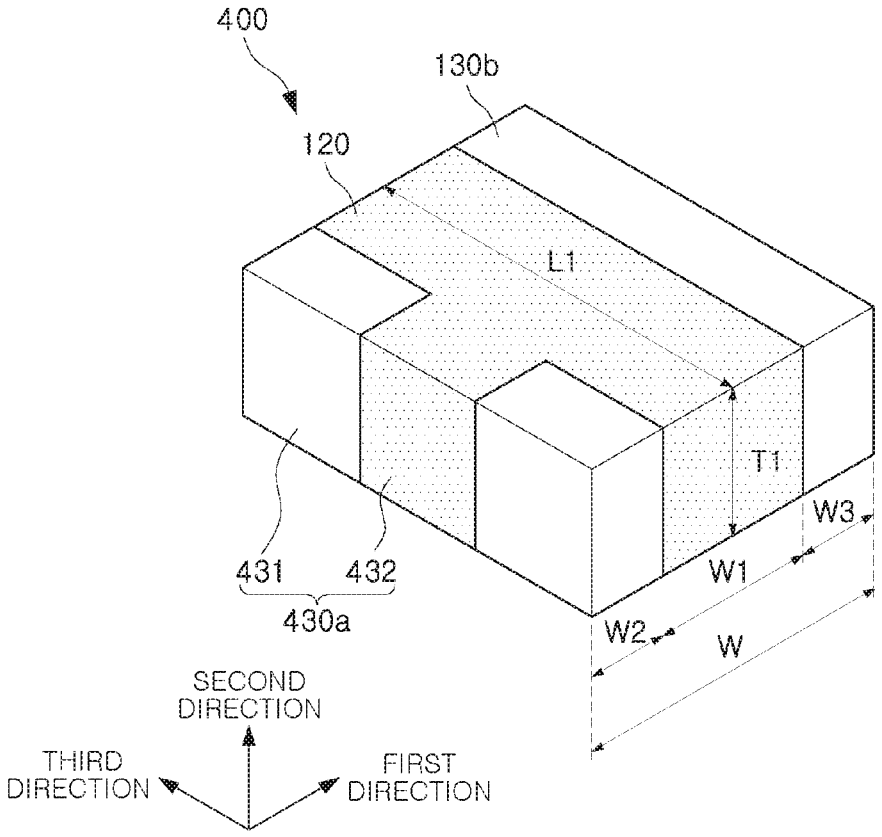
FIGS. 9 and 10 are perspective diagrams illustrating chip antennas, according to embodiments.
Figure 10:
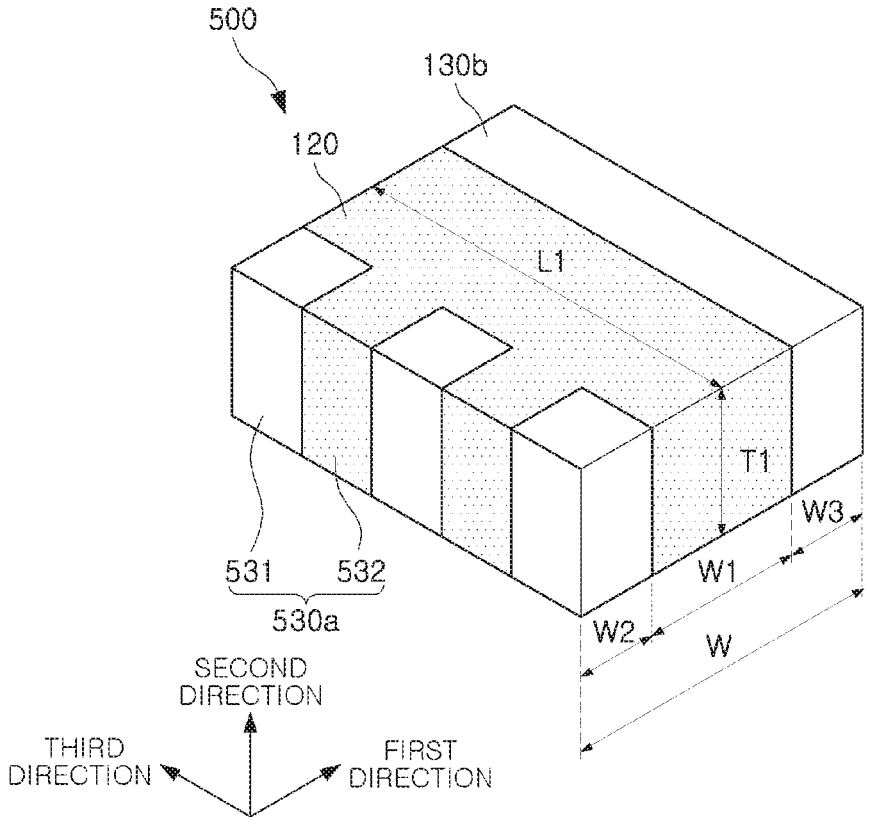

FIGS. 9 and 10 are perspective diagrams illustrating chip antennas 400 and 500, respectively, according to embodiments.

The chip antennas 400 and 500 illustrated in FIGS. 9 and 10 are similar to the chip antennas 200 and 300 illustrated in the examples in FIGS. 7 and 8, and overlapping descriptions will therefore not be provided, and only differences will be described.

Referring to FIG. 9, a radiating portion 430*a* in the chip antenna 400 may include a conductor 431 and a dielectric substance 432.

The conductor 431 and the dielectric substance 432 each may have a length and a width the same as thickness T1 and width W2 of the radiating portion 430*a*. The conductor 431 and the dielectric substance 432 may be disposed in different regions of the radiating portion 430*a* in a length direction (third direction).

As an example, a plurality of the conductors 431 may be provided, and the plurality of conductors 431 may be spaced apart from each other in the length direction (third direction), and the dielectric substance 432 may be disposed between the conductors 431. The dielectric substance 432 may be interposed between the conductors 431. Thus, an upper surface and a lower surface of the dielectric substance 432 taken in the length direction (third direction) may be bonded to the conductors 431, and the conductors 431 may be disposed on both ends of the radiating portion 430*a* in the length direction.

Since the conductors 431 and the dielectric substance 432 each have a thickness and a width that are the same as the thickness T1 and the width W2, respectively, of the radiating portion 430*a*, one surface and another surface of each of the conductors 431 and the dielectric substance 432 taken in the thickness direction may be externally exposed. One surface of each of the conductors 431 and the dielectric substance 432 taken in the width direction may be externally exposed, and the other surface of each of the conductors 431 and the dielectric substance 432 may be bonded to the body portion 120. As an example, the dielectric substance 432 may be the same as a material of the body portion 120.

The conductor 431 and the dielectric substance 432 may have different lengths. As an example, a length of the conductor 431 may be longer than a length of the dielectric substance 432. The conductor 431 may be configured to have a length longer than a length of the dielectric substance 432 such that radiating properties of the chip antenna 400 may improve. However, in other example embodiments, the conductor 431 and the dielectric substance 432 may have the same length.

Referring to FIG. 9, the radiating portion 430*a* of the chip antenna 400 may include two conductors 431 and a single dielectric substance 432 disposed between the two conductors 431.

Referring to FIG. 10, a radiating portion 530*a* of the chip antenna 500 may include three conductors 531 and two dielectric substances 532 disposed among the three conductors 531. Also, in other example embodiments, the radiating portion 530*a* of the chip antenna 500 may include four or more conductors 531 and three or more dielectric substances 532.

FIGS. 9 and 10 illustrate examples in which lengths of the conductors 431/531 may be the same, but in other example embodiments, lengths of the conductors 431/531 may be configured to be different from one another. Similarly, FIG. 10 illustrates the example in which lengths of the dielectric substances 532 may be the same, but in other example embodiments, lengths of the dielectric substances 532 may be different from each other.

Figure 11:
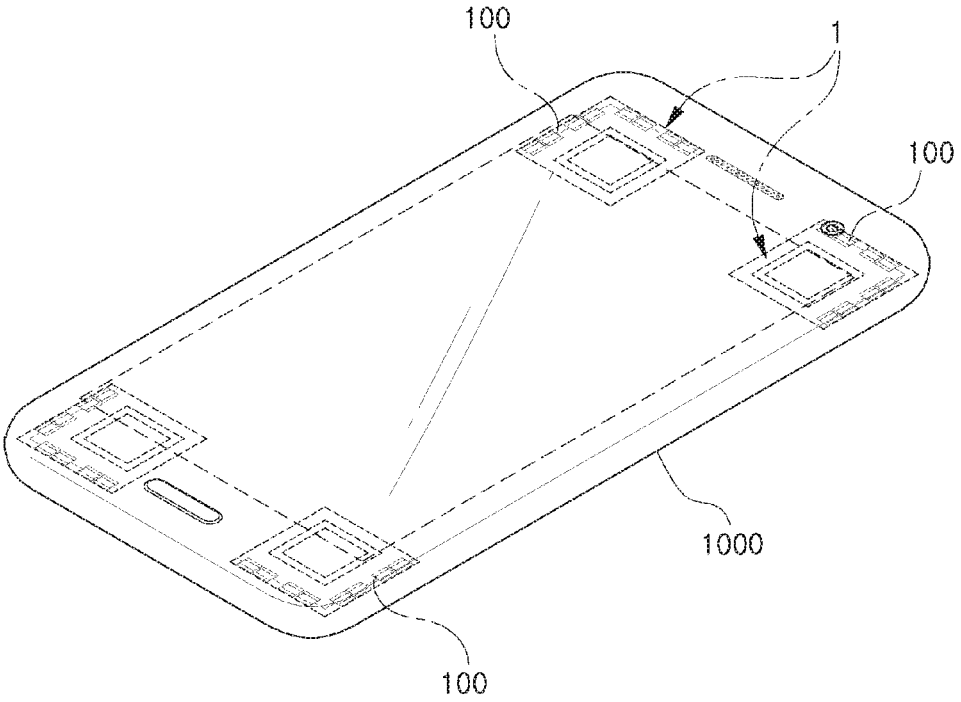
FIG. 11 is a schematic perspective diagram illustrating a portable terminal device on which an antenna module is mounted, according to an embodiment.

FIG. 11 is a schematic perspective diagram illustrating a portable terminal device 1000 on which antenna modules 1 are mounted.

Referring to FIG. 11, the antenna module 1 may be disposed on the corners of a portable terminal device 1000. The antenna module 1 may be disposed such that a chip antenna 100 is adjacent to the corners of the portable terminal device 1000.

The antenna modules 1 may be disposed on the four corners of the portable terminal device 1000, but the disclosure is not limited to this configuration. When an internal space of the portable terminal device 1000 is insufficient, only two antenna modules 1 may be disposed in a diagonal direction of the portable terminal device 1000. Thus, an arrangement of the antenna modules 1 may vary if desired. Also, the antenna module 1 may be coupled to the portable terminal device 1000 such that the feed region 11*c* is be adjacent to edges of the portable terminal device 1000. Accordingly, electromagnetic waves radiated via the chip antenna 100 may be radiated in a surface direction of the portable terminal device 1000, towards the outside of the portable terminal device 1000. Electromagnetic waves radiated via the patch antenna 90 of the antenna module 1 may be radiated in a thickness direction of the portable terminal device 1000.

According to the aforementioned example embodiments, by using a chip antenna, rather than a dipole antenna disposed in the form of wiring lines, a size of an antenna module may decrease, and transmission/reception efficiency may improve.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna, comprising:

a body portion;

a radiating portion disposed on one surface of the body portion in a width direction; and a ground portion disposed on another surface of the body portion in the width direction, wherein the radiating portion comprises a dielectric substance and a conductor each disposed on the one surface of the body portion, and the dielectric substance and the conductor are respectively disposed in different regions in a thickness direction, and wherein the conductor comprises a plurality of conductors, the dielectric substance comprises a plurality of dielectric substances, and dielectric substances among the plurality of dielectric substances are disposed between conductors among the plurality of conductors.

2. The chip antenna of claim 1, wherein a thickness of the conductor is different from a thickness of the dielectric substance.

3. The chip antenna of claim 2, wherein the thickness of the conductor is greater than the thickness of the dielectric substance.

4. The chip antenna of claim 1, wherein the conductor and the dielectric substance have a same thickness.

5. The chip antenna of claim 1, wherein the conductor is disposed on two ends of the radiating portion in a thickness direction.

6. The chip antenna of claim 1, wherein a length and a width of each of the conductor and the dielectric substance are the same as a length and a width, respectively, of the radiating portion.

7. A chip antenna, comprising:

a body portion;

a radiating portion disposed on one surface of the body portion in a width direction; and a ground portion disposed on another surface of the body portion in the width direction, wherein the radiating portion comprises a dielectric substance and a conductor each disposed on the one surface of the body portion, and the dielectric substance and the conductor are respectively disposed in different regions in a thickness direction, and wherein the dielectric substance and the body portion are formed of a same material.

8. A chip antenna, comprising:

a body portion;

a radiating portion disposed on one surface of the body portion in a width direction; and a ground portion disposed on another surface of the body portion in the width direction, wherein the radiating portion comprises a plurality of dielectric substances disposed on the one surface of the body portion and a plurality of conductors disposed on the one surface of the body portion, and the plurality of dielectric substances and the plurality of conductors are respectively disposed in different regions in a length direction.

9. The chip antenna of claim 8, wherein a length of each of the conductors is different from a length of each of the dielectric substances.

10. The chip antenna of claim 9, wherein the length of each of the conductors is greater than the length of each of the dielectric substances.

11. The chip antenna of claim 8, wherein a length of each of the conductors is the same as a length of each of the dielectric substances.

12. The chip antenna of claim 8, wherein two conductors among the plurality of conductors are respectively disposed on two ends of the radiating portion in a length direction.

13. The chip antenna of claim 8, wherein a thickness and a width of each of the conductors and each of the dielectric substances are the same as a thickness and a width, respectively, of the radiating portion.

14. The chip antenna of claim 8, wherein the dielectric substances and the body portion are formed of a same material.

15. The chip antenna of claim 8, wherein dielectric substances among the plurality of dielectric substances are disposed between conductors among the plurality of conductors.

16. A chip antenna, comprising:

a body portion;

a radiating portion disposed on one surface of the body portion in a width direction; and a ground portion disposed on another surface of the body portion in a width direction, wherein the radiating portion comprises a dielectric substance and a conductor, and the dielectric substance and the conductor are respectively disposed in different regions in a thickness direction, and wherein the conductor and the dielectric substance have a same thickness, or a length and a width of each of the conductor and the dielectric substance are the same as a length and a width, respectively, of the radiating portion.

* * * * *